US007091664B2

(12) United States Patent
Su

(10) Patent No.: US 7,091,664 B2
(45) Date of Patent: Aug. 15, 2006

(54) PLASMA DISPLAY PANEL AND METHOD OF DRIVING THEREOF

(75) Inventor: Yao-Ching Su, Taoyuan County (TW)

(73) Assignee: AU Optronics Corp., Hsinchu (TW)

( * ) Notice: Subject to any disclaimer, the term of this patent is extended or adjusted under 35 U.S.C. 154(b) by 0 days.

(21) Appl. No.: 11/336,983

(22) Filed: Jan. 23, 2006

(65) Prior Publication Data

US 2006/0113909 A1 Jun. 1, 2006

Related U.S. Application Data

(63) Continuation of application No. 10/771,311, filed on Feb. 5, 2004, now Pat. No. 7,019,460.

(51) Int. Cl.
*H01J 17/49* (2006.01)

(52) U.S. Cl. ..... 313/582; 313/491; 313/631

(58) Field of Classification Search ..... 313/491, 313/582–586, 631
See application file for complete search history.

(56) References Cited

U.S. PATENT DOCUMENTS 3,839,714 A 10/1974 Janning
6,512,336 B1 1/2003 De Zwart et al.

FOREIGN PATENT DOCUMENTS

JP 2001-176405 6/2001

*Primary Examiner*—Vip Patel
(74) *Attorney, Agent, or Firm*—Arent Fox PLLC

(57) ABSTRACT

A display device for displaying images having a plurality of rib walls, a plurality of cells formed by the rib walls, a plurality of column electrodes extending in the column direction, and a plurality of row electrodes extending in the row direction and traverse the column electrodes. The display device further includes at least two of the column electrodes that are electrically shorted.

7 Claims, 14 Drawing Sheets

PLASMA DISPLAY PANEL AND METHOD OF DRIVING THEREOF

CROSS-REFERENCE TO RELATED APPLICATIONS

This is a Continuation of application Ser. No. 10/771,311 filed Feb. 5, 2004 now U.S. Pat. No. 7,019,460. The disclosure of the prior application(s) is hereby incorporated by reference herein in its entirety.

BACKGROUND OF THE INVENTION

1. Field of the Invention

The present invention relates to improvements in plasma display panels and to improvements in methods of driving plasma display panels. In particular, the present invention provides a plasma display panel (referred to hereinafter as "PDP") with an optimal cell structure such as a triangle cell arrangement and an improved driving structure for optimally driving a PDP.

2. Related Art

A cathode ray tube (CRT) has long been the display device for displaying images on a television. In a CRT display, a gun fires a beam of negatively-charged particles (electrons) inside a large glass tube. The electrons excite phosphor atoms along the wide end of the tube, which causes the phosphor atoms to light up. The video image is produced by lighting up different areas of the phosphor coating with different colors at different intensities. Although the CRT increase the screen width in a CRT display, the length of the tube must be increased as well in order to give the scanning electron gun room to reach all parts of the screen. Consequently, a CRT having a big screen is heavy and takes up a sizeable space.

The conventional PDP was introduced to overcome some of the drawbacks of the CRT display. Specifically, the conventional PDP provides a display device with a large display screen in the form of a flat panel display, and provides an image quality and performance equal to or superior to the CRT display.

FIGS. 1A and 1B illustrate a top view and a side view, respectively of a conventional PDP 10. The conventional PDP 10 is a matrix device having individual cells defined by the intersection of row electrodes 17 and column electrodes 13. The row electrodes 17 are arranged horizontally along the screen and the column electrodes 13 are arranged vertically along the display screen. As such, the horizontal and vertical electrodes form a basic grid with cells.

FIG. 1B discloses a cross sectional side view of a single cell of a conventional grid format AC PDP 10. The display panel 10 has a rear plate 11 made of a transparent material such as glass. A column electrode 13, also referred to as an address electrode, is disposed centrally on the rear plate 11 of the cell. A dielectric layer 12 is disposed on the rear plate 11 and on the address electrode 13 such that the dielectric layer 12 covers the address electrode 13. Furthermore, rib walls 14 are located parallel to the address electrode 13 and are disposed on the dielectric layer 12. The rib walls 14 separate the cell from neighboring cells. The inside rib walls 14 of the cell is coated with a phosphor material 15 such that the phosphor material 15 gives off light when they are exposed to other light.

The upper portion of the cell includes a row electrode 17 also referred to as a display electrode, which is covered by an insulating dielectric material 18 and covered by a protective layer 16.

According to the conventional PDP 10 discussed above, each cell requires at lease one address electrode 13 intersecting with one pair of display electrode 17 (scan and common electrodes). Therefore, the conventional PDP 10 requires a large amount of address electrodes thereby requiring a large amount of integrated circuits. Consequently, the conventional PDP requires a higher voltage to drive the complex integrated circuit having a large amount of address electrodes. Thus, the conventional PDP 10 is costly to manufacture and also produces a large amount of heat during operation. Accordingly, there is a need to reduce the cost of the PDP by simplifying the integrated circuits of the PDP such that it requires a minimal amount of electrodes to function optimally. In addition, there is also a need to provide a method of driving the PDP to improve image quality.

SUMMARY OF THE INVENTION

One example of the present invention provides a display device for displaying images. The display device includes a plurality of rib walls, a plurality of cells formed by the rib walls, a plurality of column electrodes extending in column direction, and a plurality of row electrodes extending in row direction and traversing the column electrodes. The display device further includes at least two of the column electrodes that are electrically shorted.

In another example, the present invention is directed to a display device for displaying images having a plurality of rib walls; a plurality of closed cell formed by the rib walls, and a plurality of column electrodes extending in column direction. In addition, the display device includes a plurality of row electrodes extending in row direction and traversing the column electrodes. The column electrodes are formed in a zigzag configuration having a plurality of angular bends, at least one column electrode is disposed or at least two cell-columns.

DESCRIPTION OF THE DRAWINGS

The accompanying drawings, which are included to provide a further understanding of the present invention and are incorporated in and constitute a part of this specification, illustrate examples of the present invention and together with the description serve to explain the principles of the present invention.

In the drawings.

DETAILED DESCRIPTION OF THE EXEMPLARY EMBODIMENTS

Reference will now be made in detail to the exemplary embodiments of the present invention, examples of which are illustrated in the accompanying drawings.

The present invention relates to an PDP that can employ a triangular arrangement pixel having a polygon cell configuration such as a rectangular cell configuration, a hexagon cell configuration, a pentagon cell configuration, etc. The triangular arrangement pixel of the present invention includes a red color cell, a blue color cell and a green color cell.

Figure 1A:
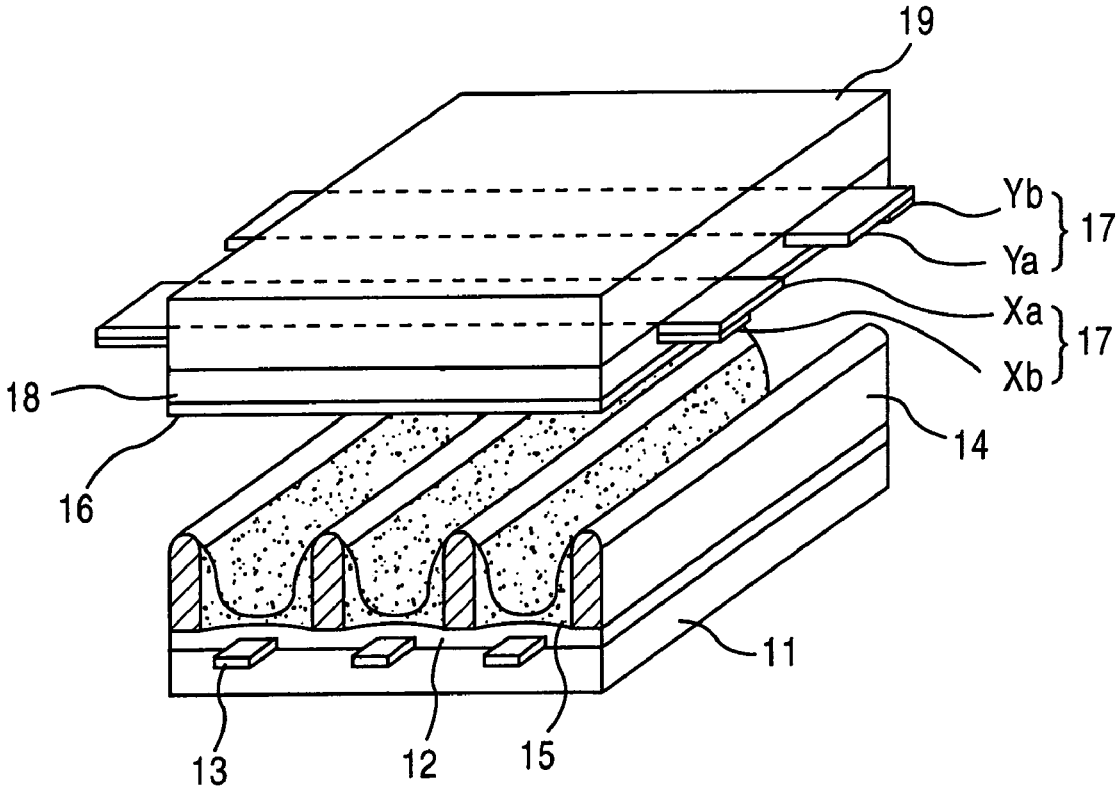
FIG. 1A PRIOR ART
FIG. 1A illustrates a conventional plasma display panel.
Figure 1B:
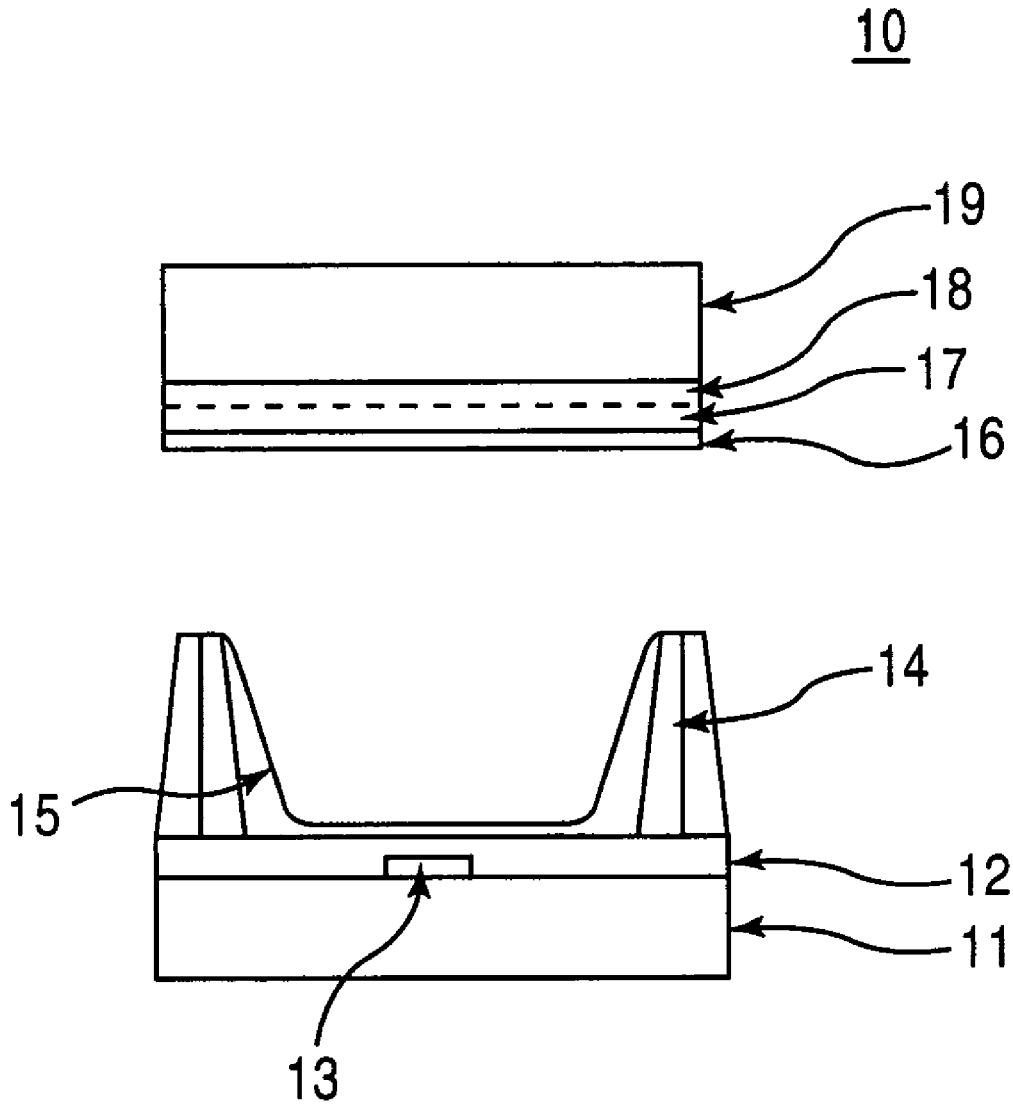
FIG. 1B PRIOR ART
FIG. 1B illustrates a side sectional view of one cell configuration from a conventional plasma display panel.
Figure 2:
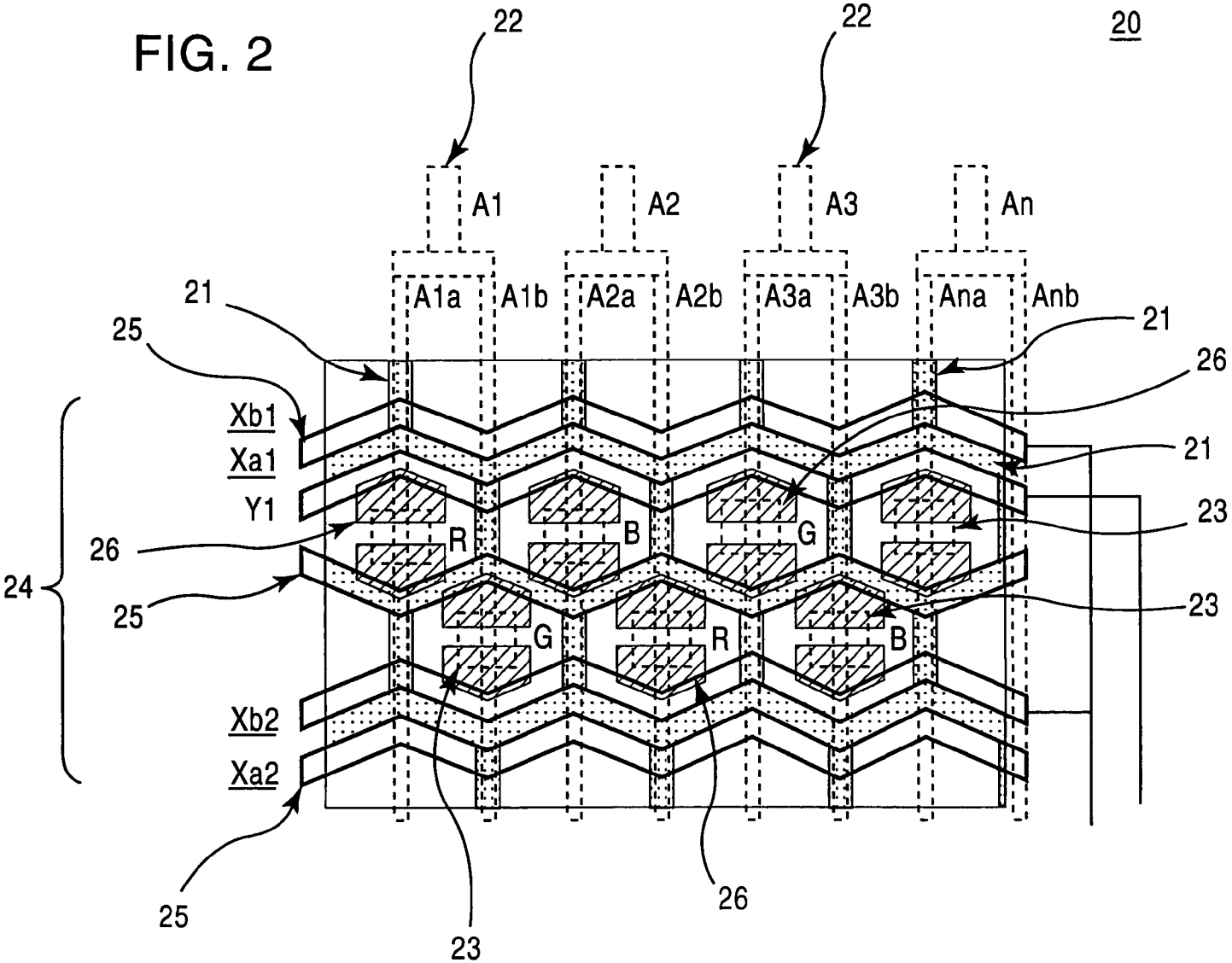
FIG. 2 illustrates a top sectional view of one example of a PDP of the present invention having a triangular color-pixel configuration such that each cell has a hexagon or honeycomb shape.

FIG. 2 illustrates a top sectional view of one example of a PDP 20 of the present invention. In particular, FIG. 2 shows a PDP 20 having a triangular color-pixel configuration such that each cell has a hexagon or honeycomb shape.

The PDP 20 includes rib wall 21 disposed on a rear plate such that the rib wall 21 forms each cell of the PDP 20. The one or more cells of the PDP 20 are closed cells formed by the rib wall 21. In addition, the PDP 20 includes one or more address electrodes 22 (A1, A2, A3 . . . An) which are also disposed on the rear plate. The address electrodes 22 are formed by electrically shorting at least two vertical or column address electrodes. For instance, address electrode 22 (A1) is formed by electrically shorting the column address electrodes A1*a* and A1*b* together. According to the present invention, the column address electrodes A1*a*, A1*b*, A2*a*, A2*b*, A3*a*, A3*b*, . . . . Ana and Anb can be electrically shorted within the display panel, within the FPC or within the integrated circuit of the PDP.

In one example of the PDP 20, the column address electrodes A1*a*, A1*b*, A2*a*, A2*b*, A3*a*, A3*b* . . . Ana and Anb are disposed vertically in an uniform rectangular stripe-shaped configuration along the length of the display, and are separated apart by a predetermined space. In yet another example of the PDP 20, the column address electrodes A1*a*, A1*b*, A2*a*, A2*b*, A3*a*, A3*b* . . . Ana and Anb are configured to include one or more expanded areas 23 such as a square or rectangular block, along the stripe shaped electrodes. The expanded areas 23 of the column address electrodes are disposed in the discharge area of the cells as shown in FIG. 2.

In addition, the PDP 20 contains a plurality of row electrodes 24 (Xb1, Xa1, Y1 . . . Xbn, Xan, Yn). The row electrodes are comprised of common electrodes Xb1, Xa1 . . . Xbn, Xbn and scan electrodes Y1 . . . Yn. Each of the row electrodes 24 also includes two types of electrodes. The first type of the row electrodes 24 is angular shaped. For instance, the first type of the row electrodes 24 is constructed in a zigzag form 25 and is disposed along the width of the PDP 20. The zigzag electrode 25 of the row electrodes 24 is also referred to as the bus electrode portion of the row electrodes 24. The bus electrodes 25 are constructed of conductive metal.

Furthermore, the second type of the row electrodes 24 protrudes from the zigzag bus electrode portion 25. In this example, the protruded electrode 26 of the row electrodes 24 has five sides and is in contact with the bus electrode 25 along the two sides of the protruded electrode 26 and extends partly over the discharge area of the cell. The protruded electrode 26 is also referred to as the sustain electrode portion of the row electrodes 24. The sustain electrodes 26 are transparent and are constructed of a transparent material such as a thin layer of metal oxide (ITO).

The PDP 20 of FIG. 2 displays one visual image by interlace scanning such that one visual image is divided into two frames, such as an odd field frame and a subsequent even field frame. In other words, two frames are driven to construct one visual image. For instance, the odd row electrodes 24 produce light during an odd field drive and the even row electrodes 24 produce light during an even field drive.

Figure 3:
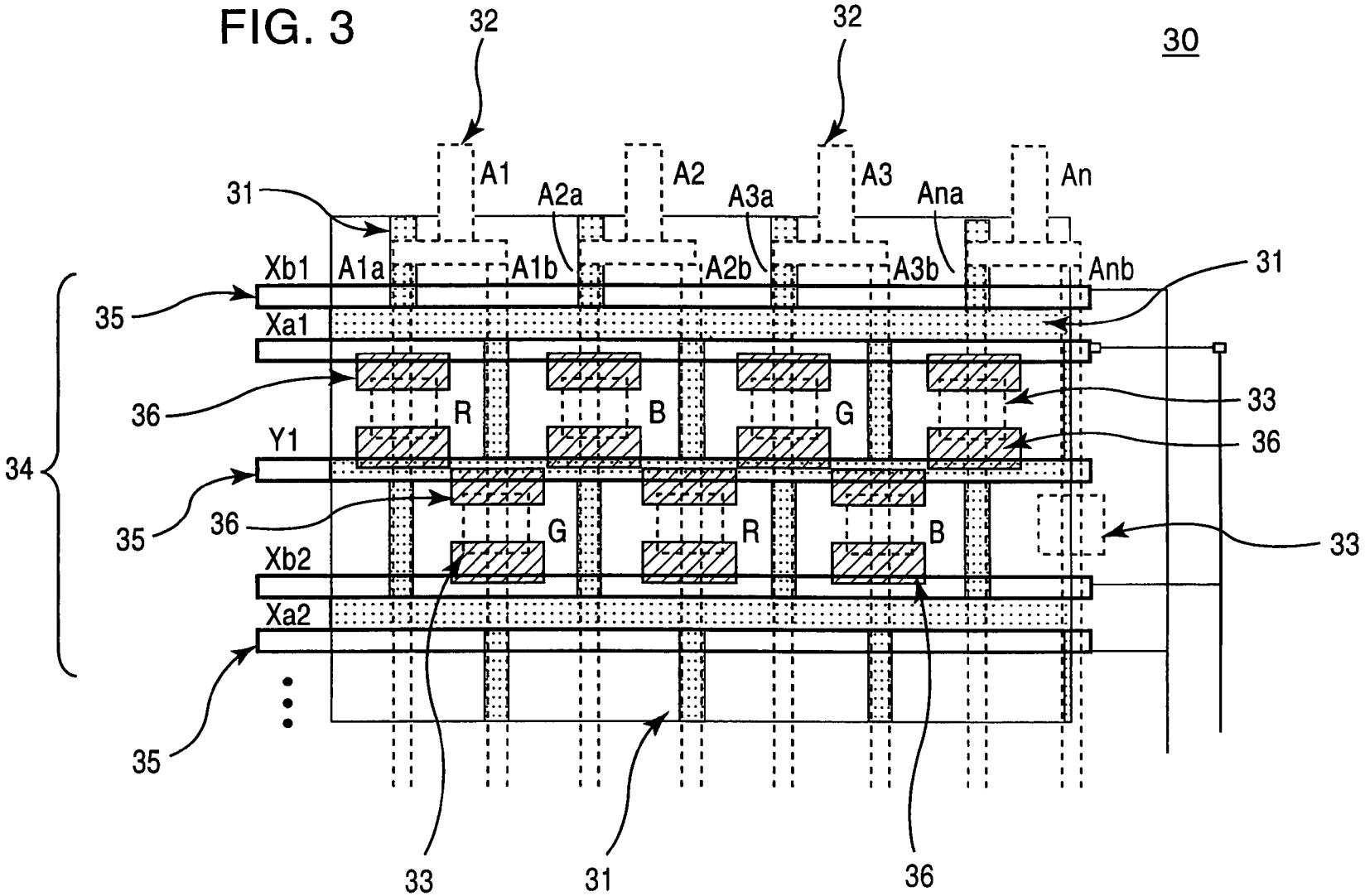
FIG. 3 illustrates a top sectional view of another example of a PDP of the present invention having a triangular color-pixel configuration such that each cell is rectangular shaped.

FIG. 3 illustrates a top sectional view of another example of a PDP 30 of the present invention. In particular, FIG. 3 shows a PDP 30 having a triangular color-pixel configuration such that each cell is rectangular shaped.

The PDP 30 includes rib wall 31 disposed on a rear plate such that the rib wall 31 forms each cell of the PDP 30 each cell being a closed cell. Therefore, the rib wall 31 forms rectangular shaped closed cells as shown in FIG. 3. In addition, the PDP 30 includes one or more address electrodes 32 (A1, A2, A3 . . . An) which are also disposed on the rear plate. The address electrodes 32 are formed by electrically shorting at least two vertical or column address electrodes. For instance, address electrode 32 (A1) is formed by electrically shorting the vertical column address electrodes A1*a* and A1*b* together. According to the present invention, the vertical column address electrodes A1*a*, A1*b*, A2*a*, A2*b*, A3*a*, A3*b*, . . . Ana and Anb can be electrically shorted within the display panel, within the FPC or within the integrated circuit of the PDP.

Similar to the example of the PDP 20 shown in FIG. 2, the column address electrodes A1*a*, A1*b*, A2*a*, A2*b*, A3*a*, A3*b* . . . Ana and Anb of FIG. 3 are also disposed vertically in an uniform rectangular stripe-shaped configuration along the length of the display, and are separated apart by a predetermined space. In addition, the column address electrodes A1*a*, A1*b*, A2*a*, A2*b*, A3*a*, A3*b* . . . Ana and Anb of PDP 30 can be configured to include one or more expanded areas 33 such as a square or rectangular block, along the stripe shaped electrodes. The expanded areas 33 of the column address electrodes are disposed in the discharge area of the cells.

The PDP 30 of FIG. 3 contains a plurality of row electrodes 34 (Xb1, Xa1, Y1 . . . . Xbn, Xan, Yn). Each of the row electrodes are comprised of common electrodes Xb1, Xa1 . . . Xbn, Xbn and scan electrodes Y1 . . . Yn. Each of the row electrodes 34 also includes two types of electrodes. The first type of electrode of the row electrodes 34 is stripe shaped and is disposed along the width of the PDP 30.

The stripe shaped electrode 35 portion of the row electrodes 34 is also referred to as the bus electrode portion of the row electrodes 34. The bus electrodes 35 are constructed of conductive metal.

Furthermore, the second type of the row electrodes 34 protrudes from the rectangular stripe bus electrode portion 35. In this example, the protruded electrode 36 of the row electrodes 34 is also rectangular shaped and is in contact with the bus electrode 35 along one side of the rectangular protruded electrode 36 and extends partly over the discharge area of the cells. The protruded electrode 36 is also referred to as the sustain electrode portion of the row electrodes 34. The sustain electrodes 36 are transparent and are constructed of a transparent material such as a thin layer of metal oxide (ITO).

Figure 4:
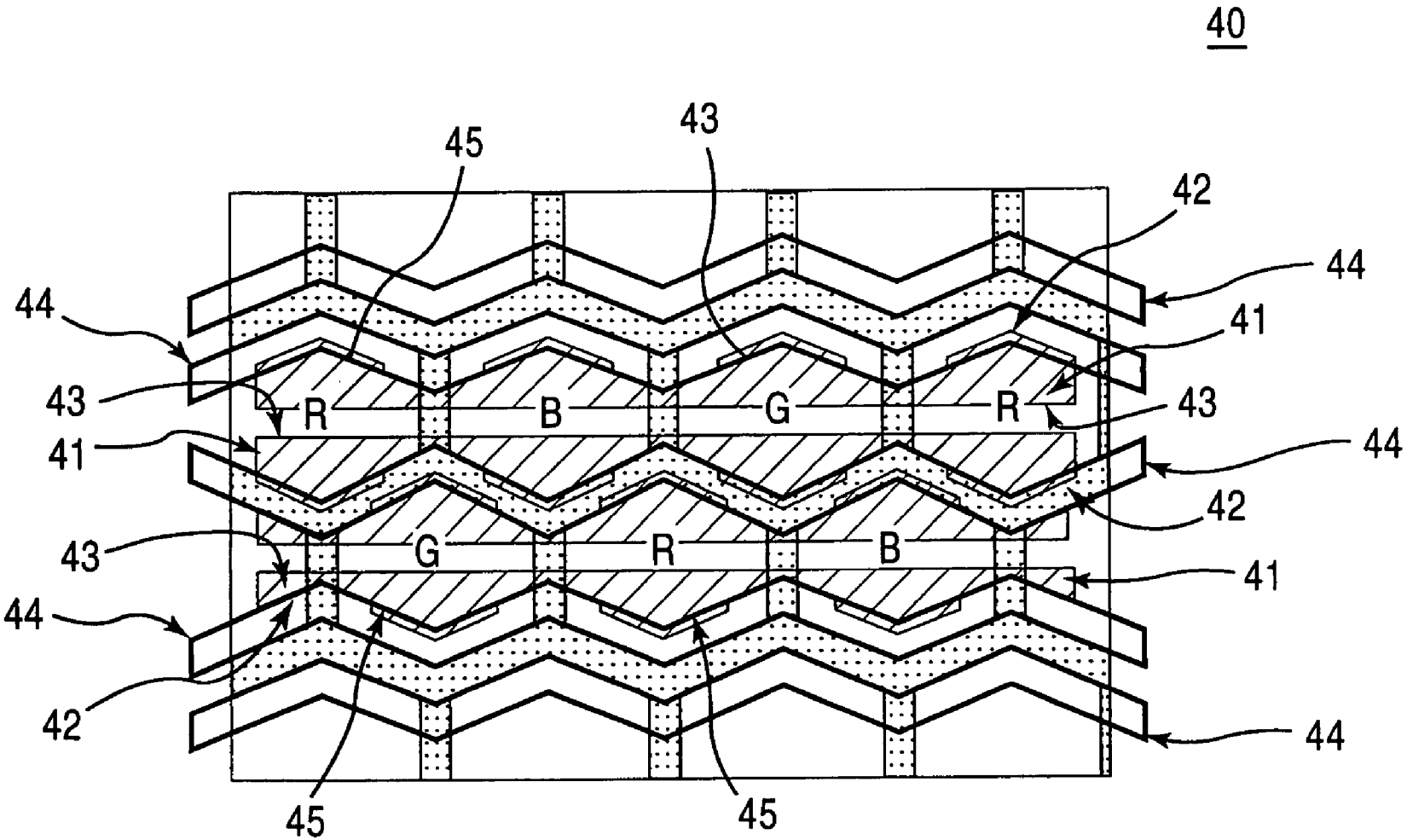
FIG. 4 illustrates a top sectional view of a PDP illustrating another example of a PDP in accordance with the present invention.

FIG. 4 shows a top sectional view of a PDP 40 illustrating another example of a PDP, in accordance with the present invention. In particular, FIG. 4 shows a PDP 40 having a triangular color-pixel configuration such that each cell has a hexagon or honeycomb shape, and having transparent sustain row electrodes 41 that are disposed horizontally along the width of the PDP 40. Specifically, each of the sustain row electrodes 41 are configured in a continuous belt-like shape and is horizontally disposed in one continuous form along the width of the PDP 40. Each of the sustain row electrodes 41 has at least one angular face 42 and one linear face 43. The angular face 42 is configured with a zigzag-like face such that the zigzag-like face is disposed adjacent to one face of a zigzag bus electrode 44. In addition, the zigzag-like face of the sustain row electrodes 41 includes one or more protrusions 45 such that the protrusions 45 extend or protrude over to the zigzag bus electrode 44 and are in contact therewith. The linear face 43 of the sustain row electrodes 41 extends partly over the discharge area of the cells.

Figure 5:
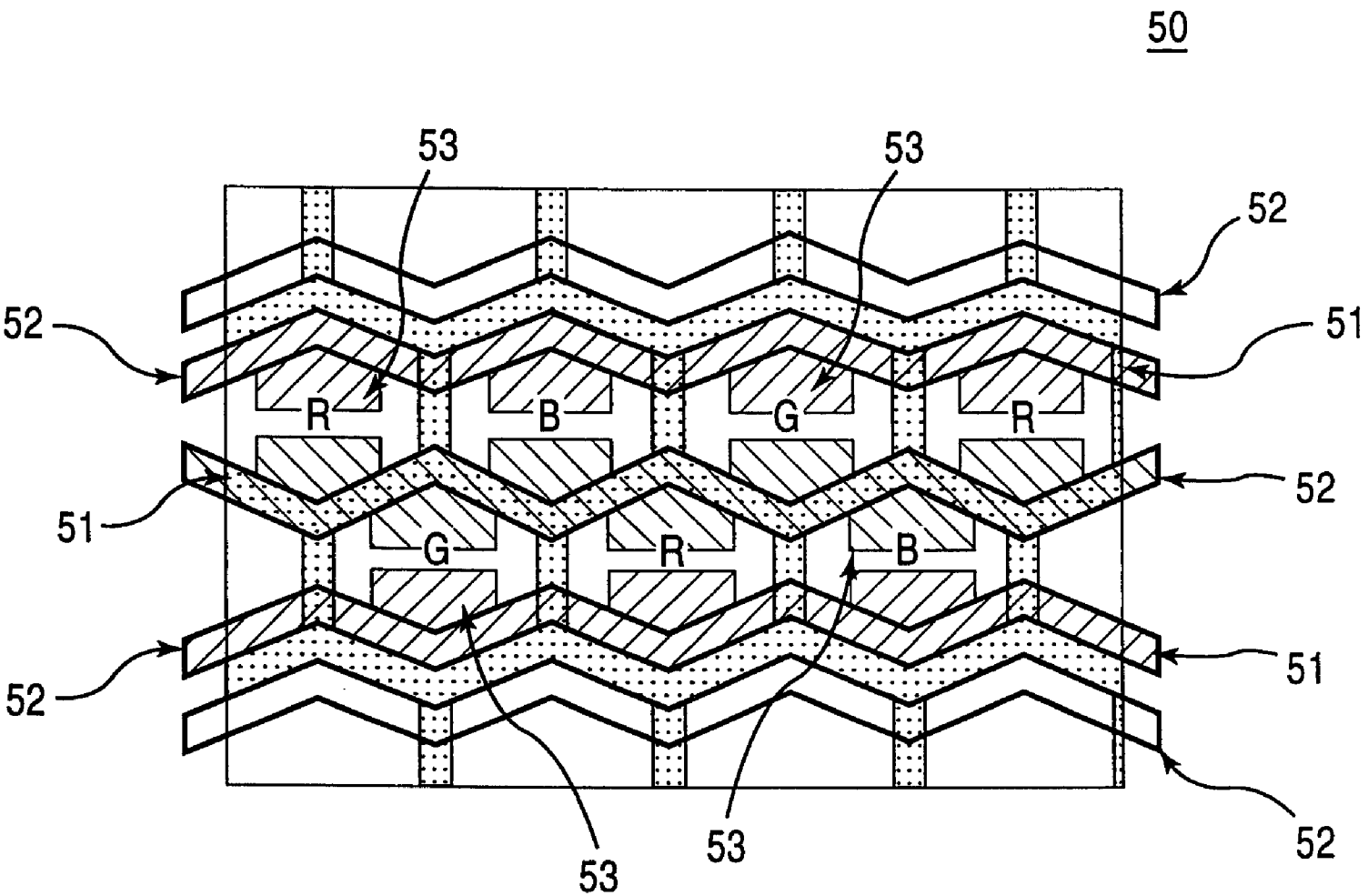
FIG. 5 illustrates a top sectional view of a PDP illustrating yet another example of a PDP in accordance with the present invention.

FIG. 5 shows a top sectional view of a PDP 50 illustrating yet another example of a PDP, in accordance with the present invention. Specifically, FIG. 5 shows a PDP 50 having a triangular color-pixel configuration such that each cell has a hexagon or honeycomb shape, and having transparent sustain row electrodes 51 that are disposed horizontally along the width of the PDP 50. Specifically, each of the sustain row electrodes 51 are horizontally disposed in one continuous form along the width of the PDP 50. Each of the sustain row electrodes 51 has at least two components. The first component of the sustain row electrodes 51 is configured in a zigzag form and is disposed along the zigzag bus electrode 52. The second component of the sustain row electrodes 51 is configured with one or more extensions 53 such that each of the extensions 53 extends partly over the discharge area of the cell.

Figure 6:
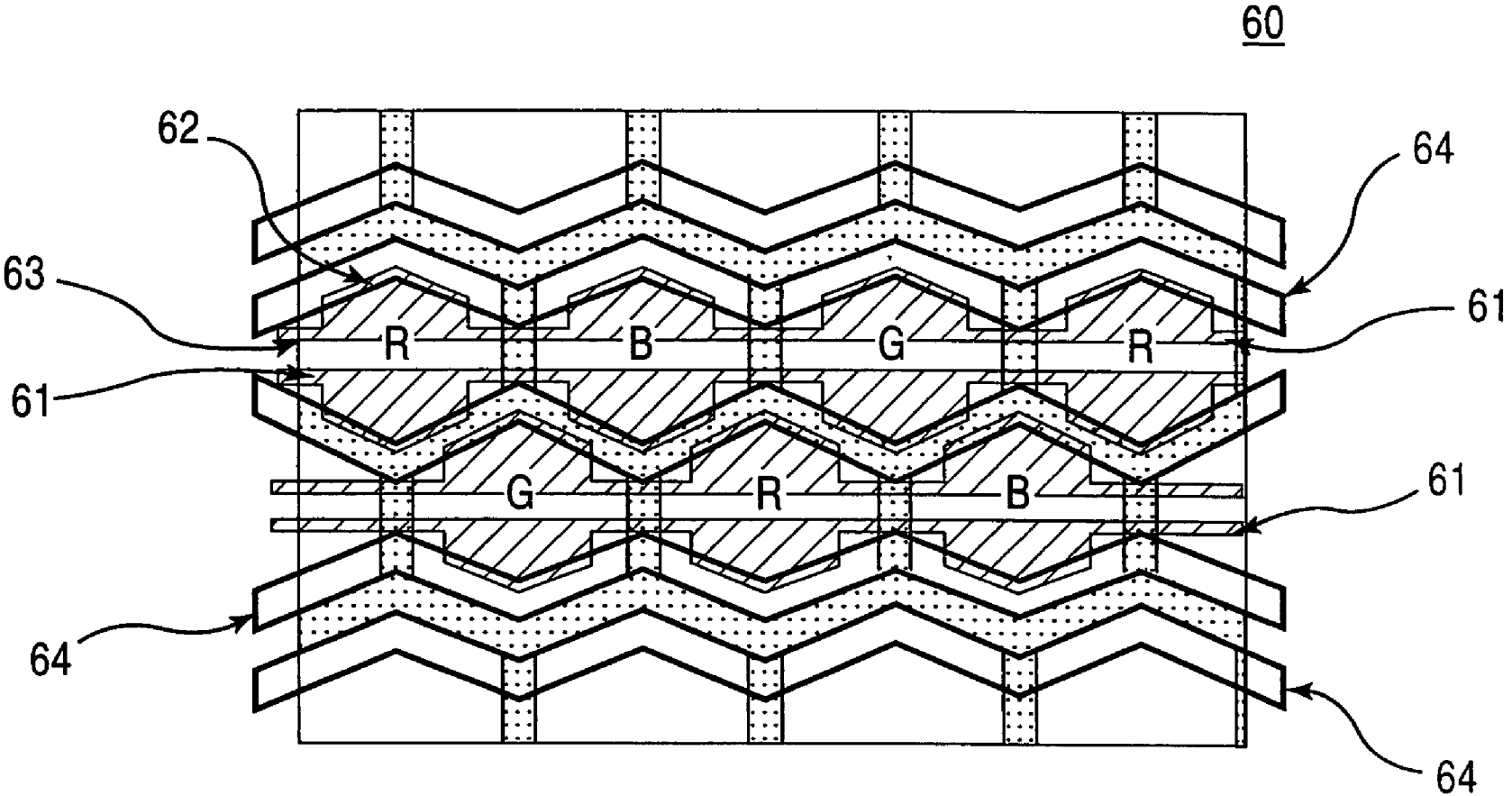
FIG. 6 illustrates a top sectional view of a PDP illustrating another example of a PDP in accordance with the present invention.

FIG. 6 shows a top sectional view of a PDP 60 illustrating another example of a PDP, in accordance with the present invention. In particular, FIG. 6 shows a PDP 60 having a triangular color-pixel configuration such that each cell has a hexagon or honeycomb shape, and having transparent sustain row electrodes 61 that are disposed horizontally along the width of the PDP 60. Specifically, each of the sustain row electrodes 61 are configured in one continuous form and is horizontally disposed along the width of the PDP 60. Each of the sustain row electrodes 61 has at least one angular face 62 and one horizontally even face 63. The angular face 62 is configured to be in contact with bus electrodes 64, and the horizontally event face 63 of the sustain row electrodes 61 is configured to extend partly over the discharge area of the cell.

Figure 7:
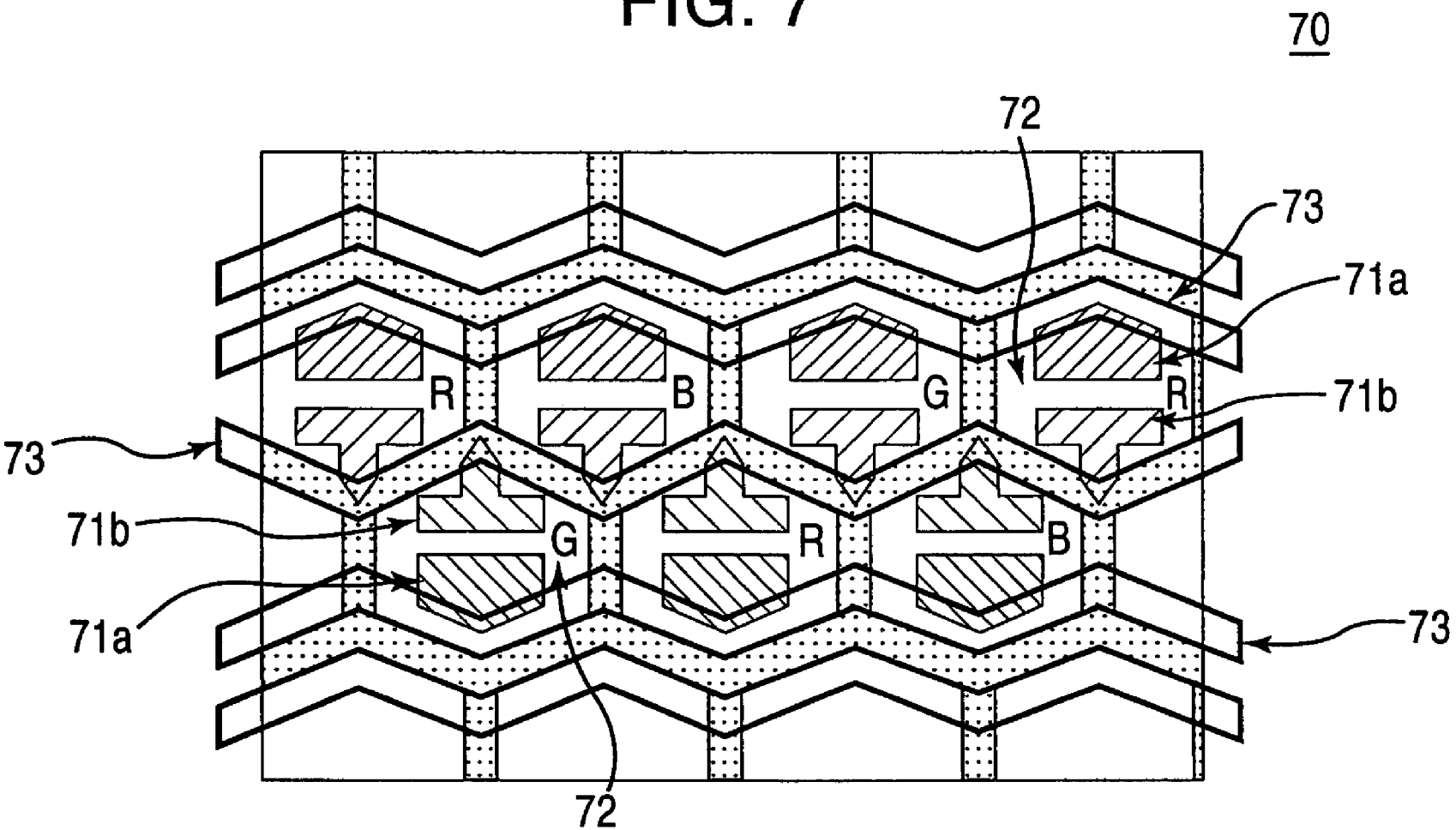
FIG. 7 illustrates a top sectional view of a PDP 40 illustrating another example of a PDP in accordance with the present invention.
Figure 8A:
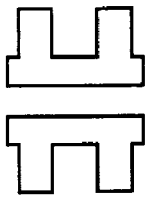
FIGS. 8A through 8H illustrate various examples of the transparent sustain electrodes that can be employed in a PDP of the present invention.
Figure 8B:
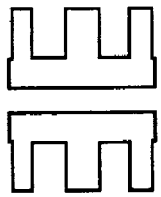
Figure 8C:
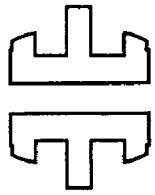
Figure 8D:
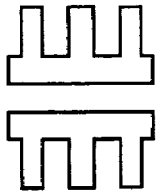
Figure 8E:
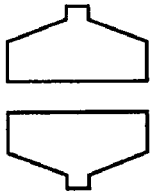
Figure 8F:
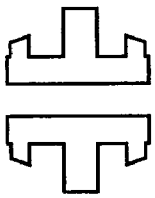
Figure 8G:
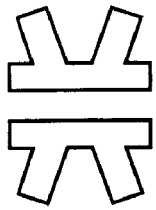
Figure 8H:
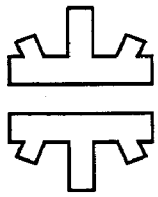

FIG. 7 shows a top sectional view of a PDP 70 illustrating yet another example of a PDP, in accordance with the present invention. In particular, FIG. 7 shows a PDP 70 having a triangular color-pixel configuration such that each cell has a hexagon or honeycomb shape, and having transparent sustain row electrodes 71*a* and 71*b*. The transparent sustain row electrodes 71 come in two configurations, and each cell 72 of the PDP 70 includes the two configurations of the transparent sustain row electrodes 71. The first configuration of the sustain electrodes 71*a* has five sides. The sustain electrodes 71*a* are coupled with the bus electrodes 73 along the two sides of the sustain electrodes 71*a* and the horizontal side of the sustain electrodes 71*a* extends partly over the discharge area of the cells 72.

The second configuration of the sustain electrodes 71*b* is T-shaped. The stem portion of the T-shaped sustain electrodes 71*b* comes to a point and is coupled with the bus electrodes 73. The top portion of the T-shaped sustain electrodes 71*b* extends partly over the discharge area of the cells 72. The sustain electrodes 71*a* and 71*b* are transparent and are constructed of a transparent material such as a thin layer of metal oxide (ITO).

FIGS. 8A to 8H show various configurations of the transparent sustain electrodes that can be employed in a PDP of the present invention. Each configuration as shown in FIGS. 8A to 8H includes a pair of identical sustain electrodes for a cell within the PDP of the present invention. Each of the sustain electrodes has an angular face and a horizontally even face. The angular face is coupled with a bus electrode (not shown) and the horizontally even face of the sustain electrodes extends partly over the discharge area of the cells.

Figure 9:
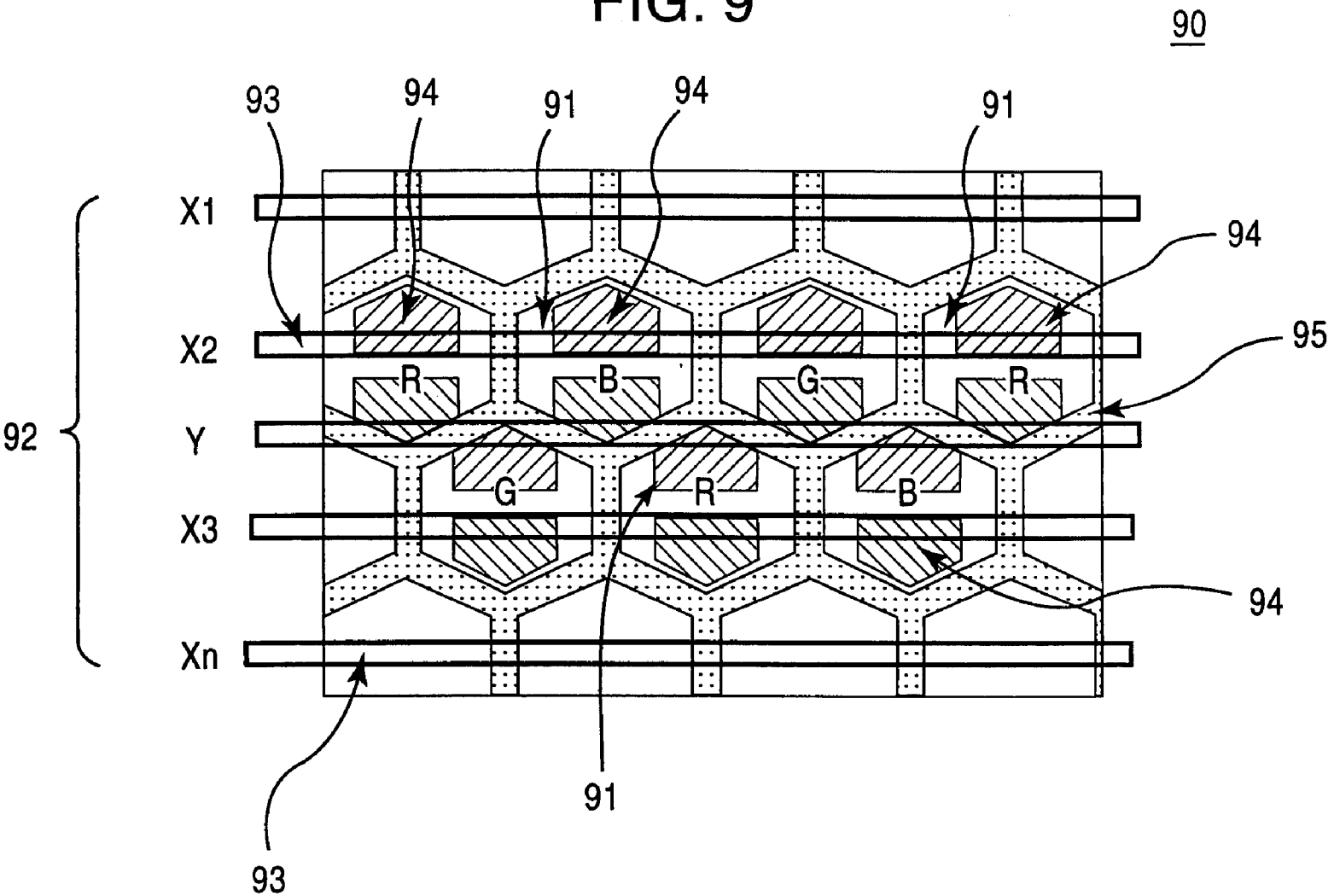
FIG. 9 illustrates a top sectional view of a PDP illustrating yet another example of a PDP in accordance with the present invention.

FIG. 9 shows a top sectional view of a PDP 90 illustrating yet another example of a PDP, in accordance with the present invention. Specifically, FIG. 9 shows a PDP 90 having a triangular color-pixel configuration such that each cell 91 has a hexagon or honeycomb shape.

Specifically, the PDP 90 includes a plurality of row electrodes 92 comprising of common electrodes X1, X2, X3 . . . Xn, and scan electrodes such as Y. The row electrode 92 of FIG. 9 is made up of two types of electrodes. The first type of electrode is a bus electrode 93, and the second type of electrode is a transparent electrode 94 such as a transparent sustain electrode. The bus electrodes portion 93 of the row electrodes 92 are disposed horizontally and linearly across the width of the PDP 90. In addition, the bus electrodes portion of the row electrodes 92 are disposed at predetermined locations on the PDP 90. For instance, the bus electrodes 93 corresponding to the common electrodes X1, X2, X3 . . . Xn are disposed horizontally and linearly across the PDP 90 such that the bus electrodes 93 are positioned close to the center of the cells 91. In other words, the bus electrodes 93 corresponding to the common electrodes X1, X2, X3 . . . Xn are proximally disposed at the discharge gap of the cells 91.

Moreover, the bus electrodes 93 corresponding to the scan electrodes, for example Y, are disposed along the zigzag rib walls 95 of the cells 91. It is noted that FIG. 9 shows the bus electrodes 93 corresponding to the scan electrodes Y1, Y2 . . . Yn as linear striped-shape bus electrodes that are positioned proximally at the center along the zigzag rib walls 95 of the cells 91. However, the bus electrodes 93 corresponding to the scan electrodes of this example can also be zigzagged-shape such that the zigzagged-shape bus electrodes 93 follow the zigzag pattern of the rib walls 95 horizontally across the PDP 90.

Furthermore, FIG. 9 illustrates the PDP 90 having transparent sustain row electrodes 94 that are disposed proximally within the cells 91. For example, each cell 91 comprises a pair of identically shaped transparent electrodes 94. The sustain row electrodes 94 have five sides and are in contact with the bus electrodes 93. For instance, the bus electrodes 93 of the common electrodes X1, X2, X3 . . . Xn are in contact with the transparent sustain electrodes 94 at about the center of the cells 91. However, the bus electrodes 93 of the scan electrodes are in contact with the transparent sustain electrodes 94 at the zigzag rib walls 95 of the PDP 90.

Figure 10:
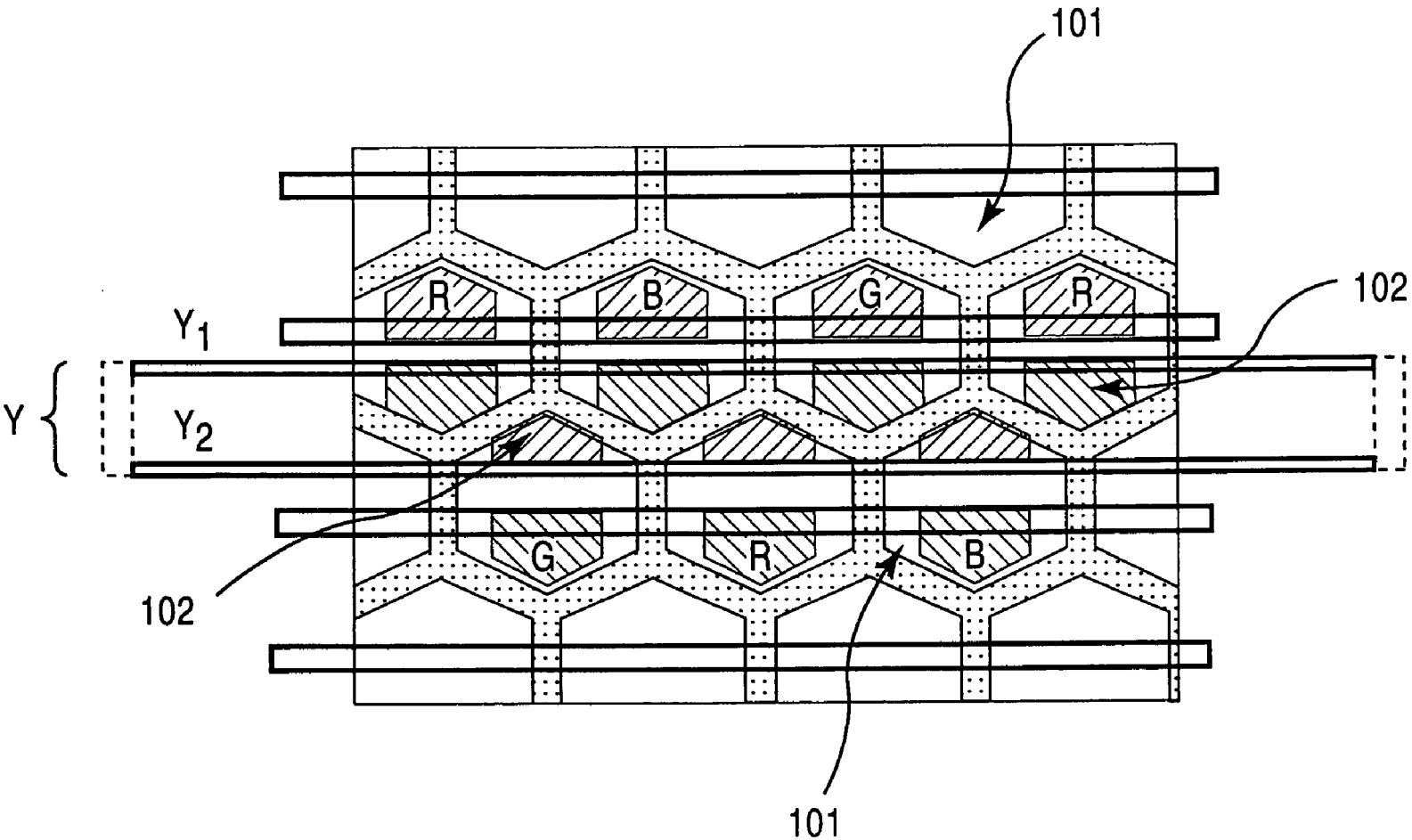
FIG. 10 illustrates a top sectional view of a PDP illustrating yet another example of a PDP in accordance with the present invention.

FIG. 10 shows a top sectional view of a PDP 100 illustrating yet another example of a PDP, in accordance with the present invention. Specifically, FIG. 10 shows a PDP 100 having a triangular color-pixel configuration such that each cell 01 has a hexagon or honeycomb shape.

Specifically, FIG. 10 shows an example of a scan electrode Y that can be implemented in the present invention. The scan electrode Y has a bus electrode portion that is divided into two bus electrode portions $Y_1$ and $Y_2$. The bus electrode portions $Y_1$ and $Y_2$ of the scan electrode Y are disposed horizontally and linearly across the width of the PDP 100. In addition, the bus electrode portions $Y_1$ and $Y_2$ are positioned close to the center of the cells 101. In other words, the bus electrodes $Y_1$ and $Y_2$ are disposed at the discharge gap of the cells 101.

FIG. 10 also shows the PDP 100 having transparent sustain row electrodes 102 that are disposed within the cells 101. For example, each cell 101 comprises a pair of identically shaped transparent electrodes 102. The sustain row electrodes 102 have five sides and are in contact with the bus electrodes $Y_1$ and $Y_2$. For instance, the bus electrodes $Y_1$ and $Y_2$ of the scan electrode Y are in contact with the transparent sustain electrodes 102 at about the center of the cells 101.

Figure 11:
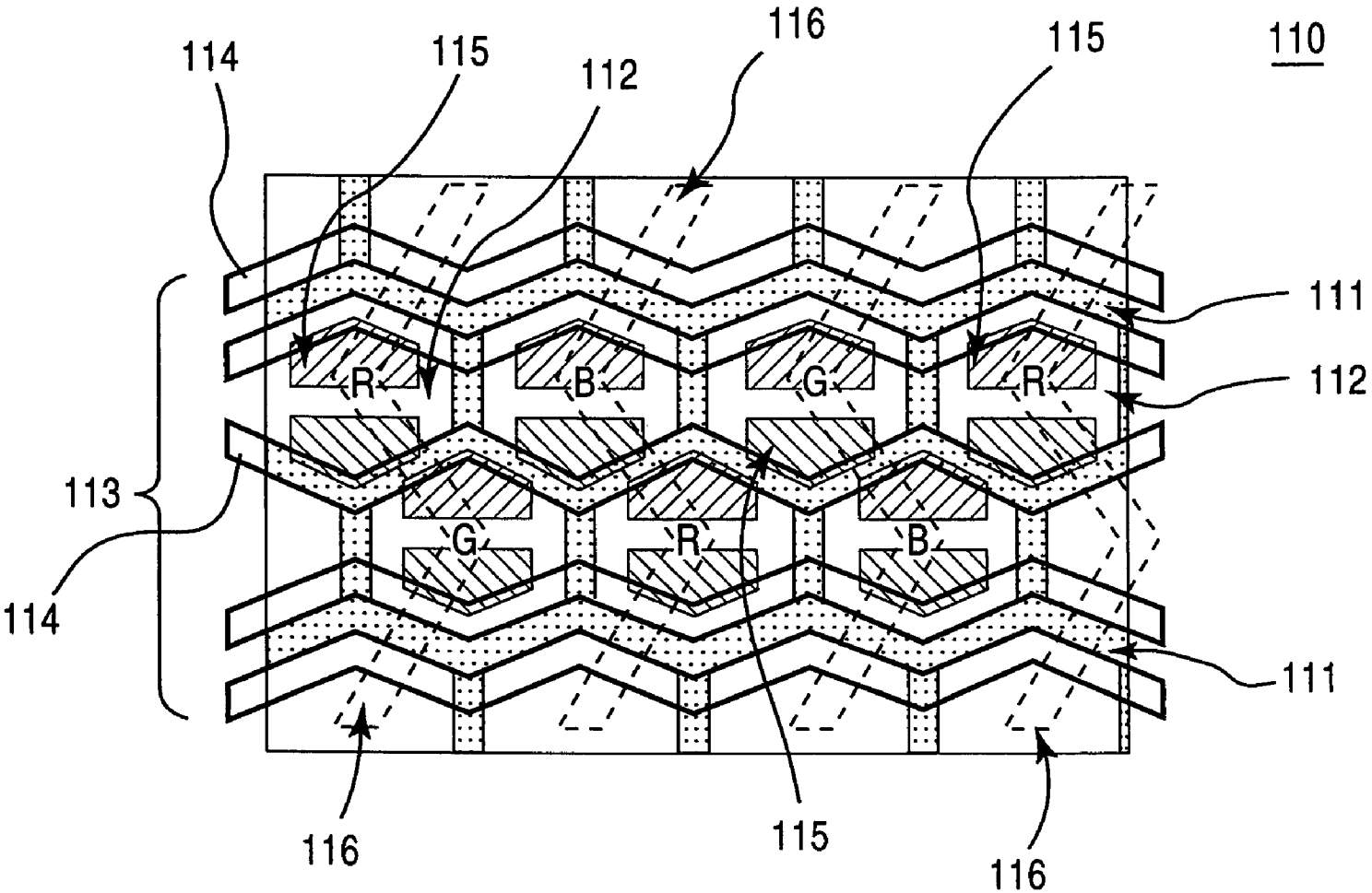
FIG. 11 illustrates a top sectional view of a PDP illustrating yet another example of a PDP in accordance with the present invention.

FIG. 11 illustrates a top sectional view of another example of a PDP 110 of the present invention. In particular, FIG. 11 shows a PDP 110 having a triangular color-pixel configuration such that each cell has a hexagon or honeycomb shape.

The PDP 110 includes rib walls 111 forming one or more hexagon cells 112 within the PDP 110. In addition, the PDP 110 contains a plurality of row electrodes 113. A row electrode 113 comprises of a bus electrode portion 114 and a transparent electrode portion 115. The bus electrode portion 114 of the row electrode 113 is constructed in a zigzag form and is disposed along the width of the PDP 110. The zigzag bus electrode 114 of the row electrode 113 are constructed of conductive metal.

Furthermore, the transparent electrode portion 115 of the row electrode 113 protrudes from the zigzag bus electrode 114. In this example, the transparent electrode portion 115 has five sides and is in contact with the zigzag bus electrode 114 and extends partly over the discharge area of the cell 112. The transparent electrode portion 115 is constructed of a transparent material such as a thin layer of metal oxide (ITO).

The PDP 110 of FIG. 11 also includes one or more address electrodes 116 configured in a zigzag form. In this example, one full zigzag interval is disposed on two cell-rows of the PDP 110.

Figure 12:
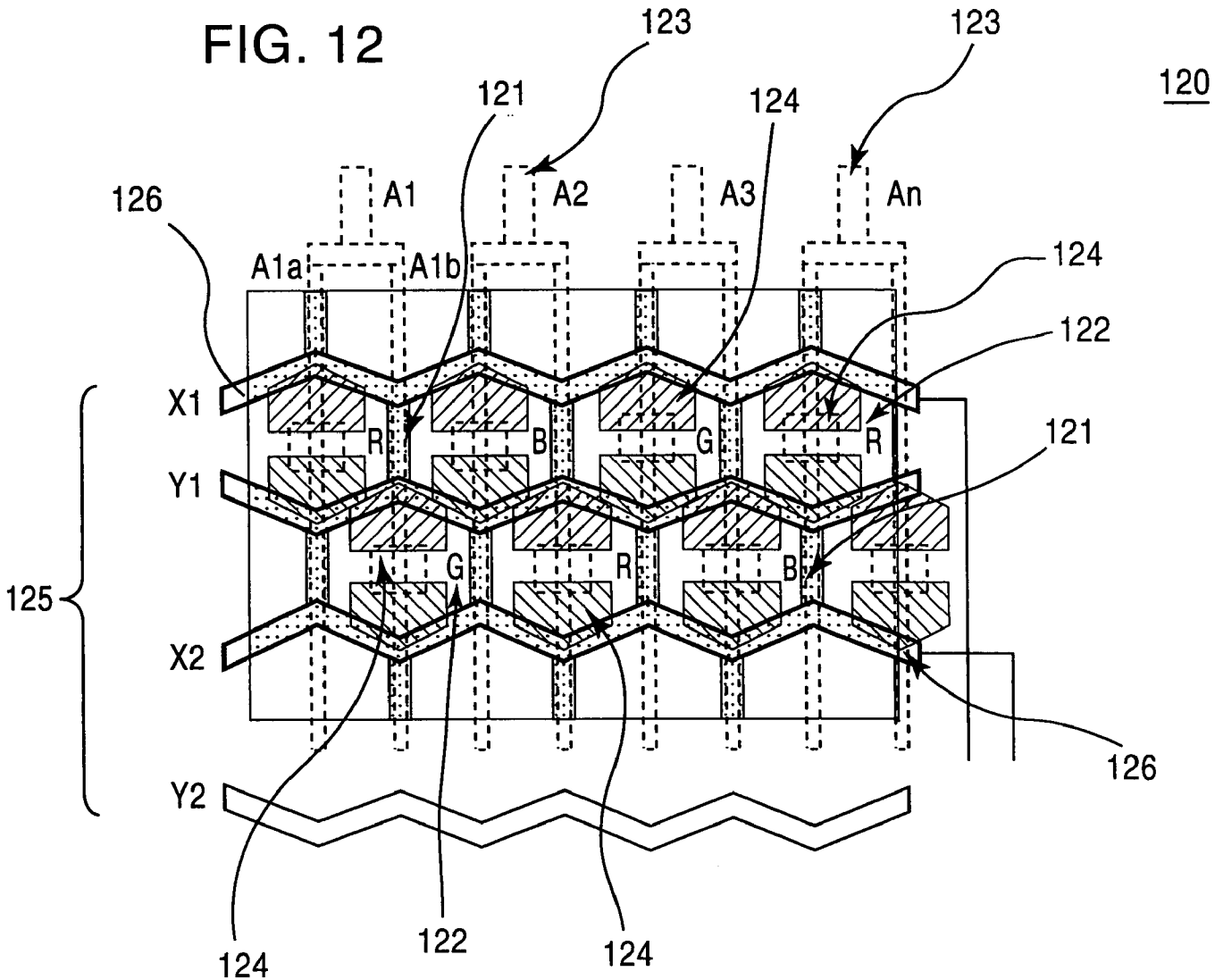
FIG. 12 illustrates a top sectional view of a PDP illustrating yet another example of a PDP in accordance with the present invention.

FIG. 12 illustrates a top sectional view of one example of a PDP 120 of the present invention. In particular, FIG. 12 shows a PDP 120 having a triangular color-pixel configuration such that each cell has a hexagon or honeycomb shape.

The PDP 120 includes rib walls 111 forming one or more hexagon cells 122 within the PDP 120. In addition, the PDP 120 includes one or more address electrodes 123 (A1, A2, A3 . . . An) which are also disposed on the rear plate. The address electrodes 123 are formed by electrically shorting at least two column address electrodes. For instance, address electrode 123 (A1) is formed by electrically shorting the column address electrodes A1*a* and A1*b* together. According to the present invention, the column address electrodes A1*a* and A1*b*, etc. can be electrically shorted within the display panel, within the FPC or within the integrated circuit of the PDP.

In one example of the PDP 120, the column address electrodes A1*a*, A1*b*, etc. are disposed vertically in an uniform rectangular stripe-shaped configuration along the length of the display, and are separated apart by a predetermined space. In yet another example of the PDP 120, the column address electrodes A1*a*, A1*b*, etc. are configured to include one or more expanded areas 124 such as a square or rectangular block, along the stripe shaped electrodes. The expanded areas 124 of the column address electrodes are disposed in the discharge area of the cells as shown in FIG. 12.

In addition, the PDP 120 contains a plurality of row electrodes 125. The row electrodes 125 are comprised of common electrodes X1, X2 . . . Xn and scan electrodes Y1, Y2 . . . Yn. A row electrode 125 is comprised of a bus electrode portion 126 and a transparent electrode portion 127. The bus electrode portion 126 of the row electrode 125 is constructed in a zigzag form and is disposed along the width of the PDP 120. The zigzag bus electrode 126 of the row electrode 125 are constructed of conductive metal.

Furthermore, the transparent electrode portion 127 of the row electrode 125 protrudes from the zigzag bus electrode 126. In this example, the transparent electrode portion 125 has five sides and is in contact with the zigzag bus electrode 126 and extends partly over the discharge area of the cell 122. The transparent electrode portion 127 is constructed of a transparent material such as a thin layer of metal oxide (ITO).

Figure 13B:
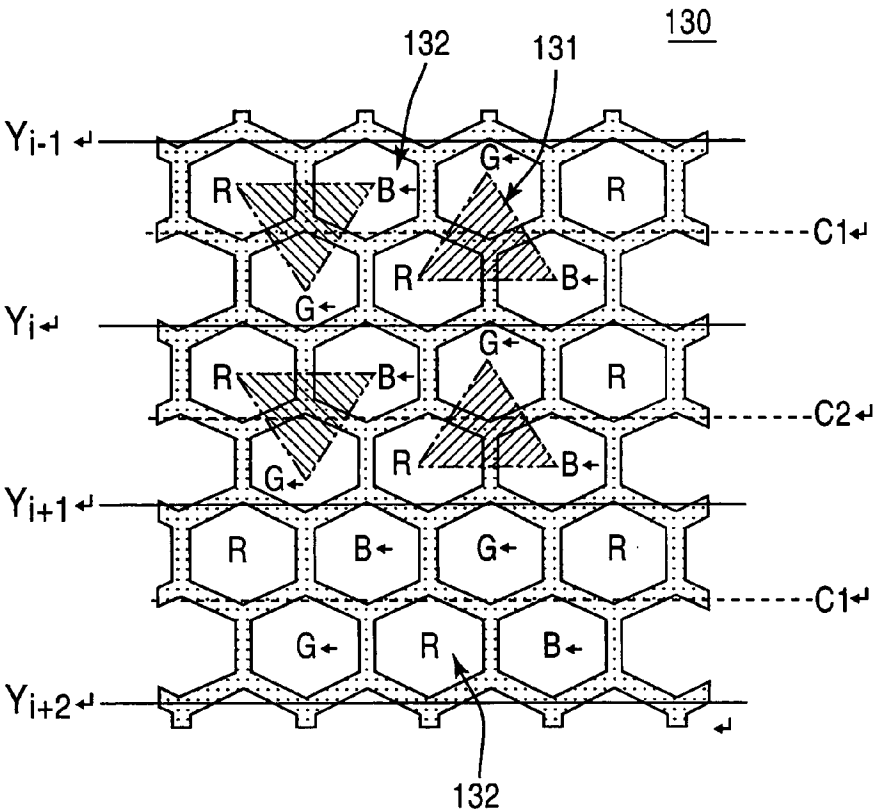
FIGS. 13A and 13B illustrate top sectional views of examples of PDPs having optimal cell structures such as triangle cell arrangements.
Figure 13A:
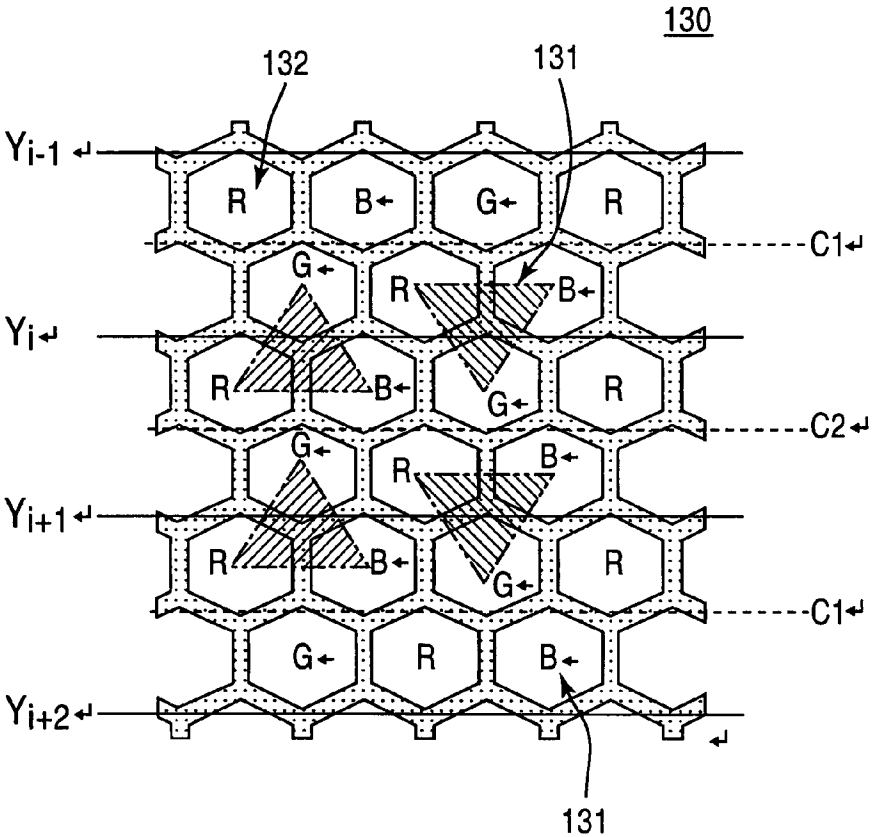

FIGS. 13A and 13B illustrate top sectional views of a PDP 130 illustrating examples of optimal cell structures such as a triangle cell arrangement 131. The PDP 130 includes a plurality of polygon cells 132. In this example, the polygon cells 132 have a hexagon configuration. Each hexagon cell is coated with a phosphor material and is filled with a gas made up of free-flowing ions and electrons. For instance, the neon and xenon gas can be used to fill the cells 132. The triangle cell arrangements 131 of the present invention makes up one pixel. The one pixel includes three cells of a red cell R, a blue cell B, and green cell G, and these color cells are evenly distributed throughout the display panel. The cells are charged and illuminated according to the discharge of the electrodes, and an image is thereby formed.

The PDP examples as discussed herein display one visual image by interlacing light such that one visual image is divided into two frames. For instance, on visual image is divided into an odd field frame and a subsequent even field frame. In other words, two frames are driven to construct one visual image. For instance, the odd row cell produce light during an odd field drive and the even row cell produce light during an even field drive. In addition, the PDP examples of the present invention employ the triangular arrangement pixel which includes a red color cell, a blue color cell and a green color cell to display visual images.

It will be apparent those skilled in the art that various modifications and variations can be made in the PDP of the present invention without departing from the spirit or scope of the invention. Thus, it is intended that the present invention cover the modifications and variations of this invention provided they come within the scope of the appended claims and their equivalents.

I claim:

1. A display device for displaying images comprising:

a plurality of rib walls;

a plurality of cells formed by the rib walls;

a plurality of column electrodes extending in column direction; and a plurality of row electrodes extending in row direction and traversing the column electrodes, wherein at least two of the column electrodes adjacent to each other are electrically shorted.

2. The display device of claim 1, wherein at least one of the row electrodes is formed in a zigzag configuration or is formed in a linear configuration.

3. The display device of claim 1, wherein at least one of the column electrodes is formed in a linear configuration having protrusions such that the protrusions are disposed proximally in the center of the polygon cells or linear strip configuration.

4. The display device of claim 1, wherein the row electrodes comprises of a plurality of common electrodes and a plurality of scan electrodes.

5. The display device of claim 4, wherein the common electrodes and the scan electrodes are alternatingly arrayed.

6. The display device of claim 5, wherein the common electrodes and the scan electrodes are alternatingly arrayed such that at least two common electrodes precedes one of the scan electrodes.

7. The display device of claim 4, wherein the row electrodes comprises of a plurality of bus electrodes such that at least one of the bus electrodes is separated into a first member and a second member, wherein the first member and the second member are positioned along a discharge area of the polygon cells.

* * * * *